US006531439B1

(12) United States Patent
Meine et al.

(10) Patent No.: US 6,531,439 B1
(45) Date of Patent: Mar. 11, 2003

(54) SURFACTANT COMBINATION CONTAINING ALKYLSULFATE AND ALKYLBENZENESULFONATE ANIONIC SURFACTANTS

(75) Inventors: Georg Meine, Mettmann (DE); Andreas Syldath, Monheim (DE); Dieter Nickel, Erkrath (DE); Thomas Mueller-Kirschbaum, Solingen (DE); Dagmar Zaika, Mettmann (DE); Ansgar Behler, Bottrop (DE); Hans-Christian Raths, Monheim (DE); Peter Sandkuehler, Erkelenz (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/623,116

(22) PCT Filed: Feb. 17, 1999

(86) PCT No.: PCT/EP99/01053

§ 371 (c)(1),
(2), (4) Date: Nov. 6, 2000

(87) PCT Pub. No.: WO99/43772

PCT Pub. Date: Sep. 2, 1999

(30) Foreign Application Priority Data

Feb. 26, 1998 (DE) ..... 198 07 805

(51) Int. Cl.[7] ..... C11D 17/00

(52) U.S. Cl. ..... 510/357; 510/392; 510/426; 510/428; 510/475; 510/511

(58) Field of Search ..... 510/351, 357, 510/426, 428, 392, 511, 475

(56) References Cited

U.S. PATENT DOCUMENTS

| | | | | |
|---|---|---|---|---|
| 4,664,839 | A | 5/1987 | Rieck | 252/175 |
| 4,816,553 | A | 3/1989 | Baur et al. | 528/245 |
| 4,820,439 | A | 4/1989 | Rieck | 252/175 |
| 5,580,941 | A | 12/1996 | Krause et al. | 527/300 |
| 5,783,616 | A | 7/1998 | Krause et al. | 524/58 |
| 5,830,956 | A | 11/1998 | Stockhausen et al. | 526/318.2 |
| 5,847,065 | A | 12/1998 | Krause et al. | 527/300 |
| 5,854,191 | A | 12/1998 | Krause et al. | 510/276 |
| 5,854,321 | A | 12/1998 | Krause et al. | 524/58 |

FOREIGN PATENT DOCUMENTS

| | | |
|---|---|---|
| DE | 42 21 381 | 2/1994 |
| DE | 43 00 772 | 7/1994 |
| DE | 197 46 780 | 4/1999 |
| EP | 0 164 514 | 12/1985 |
| EP | 0 280 223 | 8/1988 |
| EP | 0 525 239 | 2/1993 |
| EP | WO96/21705 | 7/1996 |
| GB | 2 289 687 | 11/1995 |
| WO | WO95/02390 | 1/1995 |

*Primary Examiner*—Necholus Ogden
(74) *Attorney, Agent, or Firm*—Stephen D. Harper; Glenn E. J. Murphy

(57) ABSTRACT

Surfactant combinations containing $C_{12-18}$ alkyl sulfates wherein less than 10% by weight of the $C_{12-18}$ alkyl sulfates, based on the $C_{12-18}$ alkyl sulfates, have carbon chains with fewer than 14 carbon atoms and $C_{9-13}$ alkyl benzenesulfonates in a weight ratio of 1:10 to 10:1. The combinations are useful in powder and granular as well as liquid washing and cleaning detergents.

13 Claims, No Drawings

SURFACTANT COMBINATION CONTAINING ALKYLSULFATE AND ALKYLBENZENESULFONATE ANIONIC SURFACTANTS

BACKGROUND OF THE INVENTION

This invention relates to a surfactant combination containing special fatty alkyl sulfates in combination with alkyl benzenesulfonates.

In the domestic washing of laundry, there has been a tendency in recent years for the laundry to be washed at increasingly lower temperatures. The main washing temperatures are between 40 and 60° C. In most homes, the boil wash is no longer practised. On the other hand, however, detergents are expected to develop a uniform and very high cleaning performance at the washing temperatures applied over the entire range of soils occurring in domestic laundry, such as dust and sebum, cosmetics and pigments which mostly emanate from foods, decorative cosmetics (lipstick, makeup, creams, etc.), care products, such as shoe creams, or from general (street) soil. In terms of washing activity, most of the surfactant combinations known from the prior art have a performance maximum at relatively high temperatures. Even the particularly high-performance detersive substances, such as certain anionic surfactants, develop their maximum activity against certain soils, but not against the entire range of soils encountered in domestic laundry. Thus, the alkyl benzenesulfonates, for example, are particularly effective above all against lipstick soils, but have a weakness against dust and sebum.

International patent application WO 95/02390 describes a surfactant system based on alkyl sulfates emanating from natural raw materials which contain a mixture of alkyl chain lengths, the alkyl sulfates having such a weight distribution of the alkyl chain lengths that they contain less than 20% by weight of alkyl chains with 12 carbon atoms, 30 to 80% by weight of alkyl chains with 14 carbon atoms, 30 to 50% by weight of alkyl chains with 16 carbon atoms and less than 10% by weight of alkyl chains with 18 carbon atoms.

However, alkyl sulfates are known to lack uniform activity against all soils at relatively low washing temperatures. Their strength in performance terms is against dustlsebum soils.

Another surfactant system containing special fatty alkyl sulfates is disclosed in International patent application WO 96/21705. The surfactant composition described therein contains (a) an alkyl sulfate surfactant system containing a mixture of alkyl chain lengths, the weight distribution of the alkyl chains being such that less than 20% by weight of the alkyl chains have a chain length of less than 14. The composition contains (b) a nonionic surfactant and (c) a zeolite builder comprising zeolite P with an Si:Al ratio of no greater than 1.33:1 (zeolite MAP) as further components.

GB-A-2 289 687 describes a powder-form detergent with a density of at least 650 g/l containing (a) from 1 to 50% by weight of a surfactant system, (b) from 2 to 25% by weight of a calcium salt and (c) at least 1% by weight of a builder. The surfactant system contains at least 30% by weight of a sulfated surfactant selected from the group of alkyl sulfates, alkyl ethoxysulfates, secondary alkyl sulfates and mixtures thereof. The alkyl sulfates used are, for example, alkyl sulfates containing 14 to 16 carbon atoms in the carbon chain.

The problem addressed by the present invention was to provide a surfactant system which could be used both in powder-form to granular detergents and in liquid detergents and which would develop an improved cleaning performance against a wide range of different soil types. In addition, the surfactant system would contain components which are commercially obtainable at favorable prices and which exhibit ecologically favorable properties.

It has now surprisingly been found that, by using a special combination of anionic surfactants in detergents, it is possible to obtain optimal cleaning performance against various soils for the same concentration of detersive components.

DESCRIPTION OF THE INVENTION

Accordingly, the present invention relates to a surfactant combination for use in detergents containing $C_{12-18}$ alkyl sulfates, the percentage of carbon chains with fewer than 14 carbon atoms and the percentage of carbon chains with more than 16 carbon atoms being less than 10% by weight in either case, based on the content of $C_{12-18}$ alkyl sulfate, and $C_{9-13}$ alkyl benzenesulfonates in a ratio of 1:10 to 10:1.

In one preferred embodiment, the percentage of carbon chains with more than 16 carbon atoms is less than 10% by weight, based on the content of $C_{12-18}$ alkyl sulfates.

In another preferred embodiment, the percentage of carbon chains with more than 16 carbon atoms in the $C_{12-18}$ alkyl sulfates used is above 10 and below 20% by weight, based on the content of $C_{12-18}$ alkyl sulfates.

Particularly good washing results are obtained when the percentage of alkyl sulfates with a chain length of 14 carbon atoms in the $C_{12-18}$ alkyl sulfates is from 40 to 80% by weight, based on the $C_{12-18}$ alkyl sulfates.

The $C_{12-18}$ alkyl sulfates present in the surfactant combination according to the invention are known anionic surfactants which can be obtained by sulfonation of the corresponding alcohols. The required carbon chain cut can be obtained by using the corresponding alcohols with the corresponding chain length distribution prepared synthetically or from natural raw materials or corresponding pure starting compounds.

The $C_{8-18}$ alkyl benzenesulfonates are known anionic surfactants which are obtained by sulfonation of the $C_{8-18}$ monoolefins containing a terminal or internal double bond with gaseous sulfur trioxide and subsequent alkaline or acidic hydrolysis of the sulfonation products. The $C_{9-13}$ alkyl benzenesulfonates are normally used; longer-chain alkyl benzenesulfonates are largely not used.

In one preferred embodiment, the $C_{12-18}$ alkyl sulfates and the $C_{9-13}$ alkyl benzenesulfonates are preferably used in a ratio of 1:1 to 4:1.

The surfactant combination according to the invention is suitable for use in powder-form or granular detergents and in liquid detergents.

The surfactants may be added to the detergents both individually and in the form of compounds. The compounds are preferably produced by granulation processes, particularly in a fluidized bed.

Accordingly, the present invention also relates to powder-form or granular detergents which contain the surfactant combination according to the invention in combination with other typical ingredients.

The present invention also relates to liquid detergents which contain the surfactant combination according to the invention, a suitable solvent and optionally other typical ingredients.

The powder-form or granular or liquid detergents according to the invention contain the $C_{12-18}$ alkyl sulfates from the surfactant combination in a quantity of preferably 1 to 20% by weight, based on the detergent as a whole. The $C_{9-13}$ alkyl benzenesulfonates are present in the detergents according to the invention in a quantity of preferably 1 to 20% by weight, based on the detergent as a whole.

The detergents according to the invention may contain other anionic surfactants, nonionic surfactants, builders and optionally other substances typically present in detergents as further constituents.

The other anionic surfactants may be selected, for example, from $C_{8-22}$ olefin sulfonates, $C_{8-22}$ alkanesulfonates, $C_{8-22}$ alkenyl sulfates, monoesters and/or diesters of alkyl sulfosuccinic acid (sulfosuccinates), $C_{6-18}$ alkyl polyglycol ether sulfates, $C_{8-22}$ fatty acid ester sulfonates, $C_{8-22}$ alkyl ether sulfates, glycerol ether sulfonates, glycerol ether sulfates, hydroxy mixed ether sulfates, monoglyceride sulfates, sulfoglycerides, amido acids, $C_{6-18}$ fatty acid amide ether sulfates, $C_{6-18}$ alkyl (ether) carboxylates, fatty acid isethionates, N—$C_{6-16}$-acyl sarcosinates, N—$C_{6-18}$-acyl taurides, $C_{6-18}$ alkyl oligoglycoside sulfates, $C_{6-18}$ alkyl phosphates, soaps and mixtures thereof. The anionic surfactants may be used in the form of their sodium, potassium or ammonium salts and as soluble salts of organic bases, such as mono-, di- or triethanolamine. The anionic surfactants are preferably present in the form of their sodium or potassium salts, more particularly in the form of the sodium salts.

The content of other anionic surfactants in the detergents is preferably up to 10% by weight.

The detergents may contain $C_{8-18}$ alcohol alkoxylates, alkyl polyglycosides, alkoxylated, preferably ethoxylated or ethoxylated and propoxylated $C_{8-18}$ fatty acid alkyl esters, N-fatty alkyl amine oxides, polyhydroxy fatty acid amides or mixtures thereof as nonionic surfactants.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil alcohol, palm oil alcohol, tallow alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 7 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are (tallow) fatty alcohols containing 14 EO, 16 EO, 20 EO, 25 EO, 30 EO or 40 EO.

In one particularly preferred embodiment, the detergents contain $C_{12-16}$ fatty alcohol alkoxylates with an average degree of alkoxylation of 5.2 to 5.8 and preferably 5.4 to 5.6 as the nonionic surfactant.

Other preferred nonionic surfactants are alkyl glycosides corresponding the general formula $RO(G)_x$ where R is a primary, linear or methyl-branched, more particularly 2-methyl-branched, aliphatic radical containing 8 to 22 and preferably 12 to 18 carbon atoms and G stands for a glycose unit containing 5 or 6 carbon atoms, preferably glucose. The degree of oligomerization x, which indicates the distribution of monoglycosides and oligoglycosides, is between 1 and 10 and preferably between 1.2 and 4.

The content of nonionic surfactants in the final detergents is preferably from 2 to 45% by weight and more preferably above 20% by weight, the content of nonionic surfactants in liquid detergents generally being above 10% by weight.

Suitable inorganic builders are, for example, phosphates, preferably tripolyphosphates, and also orthophosphates and pyrophosphates, zeolite and crystalline layer silicates.

The finely crystalline, synthetic zeolite containing bound water used in accordance with the invention is preferably zeolite A and/or zeolite P. Zeolite MAP® (Crosfield) is a particularly preferred P-type zeolite. However, zeolite X and mixtures of A, X and/or P are also suitable. Also of particular interest is a co-crystallized sodium/potassium aluminium silicate of zeolite A and zeolite X which is commercially available as VEGOBOND AX® (a product of Condea Augusta S.p.A.). The zeolite may be used as a spray-dried powder or even as an undried suspension still moist from its production. If the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have a mean particle size of less than 10 $\mu$m (volume distribution, as measured by the Coulter Counter Method) and contain preferably 18 to 22% by weight and more preferably 20 to 22% by weight of bound water.

Suitable substitutes or partial substitutes for phosphates and zeolites are crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β and δ-sodium disilicates $Na_2Si_2O_5.yH_2O$ are particularly preferred.

Useful organic builders are, for example, polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. The (co)polymeric polycarboxylates may be present in the detergents in quantities of preferably 1 to 8% by weight and more preferably 2 to 6% by weight.

Also particularly preferred are biodegradable polymers of more than two different monomer units, for example those which contain salts of acrylic acid and maleic acid and vinyl alcohol or vinyl alcohol derivatives as monomers in accordance with DE-A-43 00 772 or salts of acrylic acid and 2-alkylallyl sulfonic acid and sugar derivatives as monomers in accordance with DE-C-42 21 381.

Other suitable builders are polyacetals which may be obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Other suitable ingredients of the detergents are water-soluble inorganic salts, such as bicarbonates, carbonates, amorphous silicates or mixtures thereof. More particularly, alkali metal carbonate and amorphous alkali metal silicate, above all sodium silicate with a molar $Na_2O:SiO_2$ ratio of 1:1 to 1:4.5 and preferably 1:2 to 1:3.5, are used. The sodium carbonate content of the detergents is preferably up to 20% by weight and advantageously between 2 and 15% by weight. The sodium silicate content of the detergents is generally up to 10% by weight and preferably between 2 and 8% by weight.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecanedioic acid. The content of bleaching agents in the detergents is preferably 5 to 25% by weight and more preferably from 10 to 20% by weight, perborate monohydrate or percarbonate advantageously being used.

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the detergent.

Where the detergents are used in washing machines, it can be of advantage to add typical foam inhibitors to them. Suitable foam inhibitors are, for example, soaps of natural or synthetic origin which have a high percentage content of $C_{18-24}$ fatty acids. Suitable non-surface-active foam inhibitors are, for example, organopolysiloxanes and mixtures thereof with microfine, optionally silanized, silica and also paraffins, waxes, microcrystalline waxes and mixtures thereof with silanized silica or bis-stearyl ethylenediamide. Mixtures of different foam inhibitors, for example mixtures of silicones, paraffins and waxes, may also be used with advantage. The foam inhibitors, more particularly silicone- and/or paraffin-containing foam inhibitors, are preferably fixed to a granular water-soluble or water-dispersible support. Mixtures of paraffins and bis-stearyl ethylenediamides are particularly preferred.

The neutrally reacting sodium salts of, for example, 1-hydroxyethane-1,1-diphosphonate, diethylenetriamine pentamethylene phosphonate or ethylenediamine tetramethylene phosphonate in quantities of 0.1 to 1.5% by weight are preferably used as the salts of polyphosphonic acids.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned may also be used.

Examples of bleach activators are N-acyl or O-acyl compounds which form organic peracids with $H_2O_2$, preferably polyacylated alkylene diamines, such as N,N'-tetraacylated diamines, acylated glycolurils, more especially tetraacetyl glycoluril, N-acylated hydantoins, hydrazides, triazoles, triazines, urazoles, diketopiperazines, sulfuryl amides and cyanurates, also carboxylic acid esters, such as p-(alkanoyloxy)benzenesulfonates, more especially sodium isononanoyloxy-benzenesulfonate, and p-(alkenoyloxy)-benzenesulfonates; caprolactam derivatives, carboxylic anhydrides, such as phthalic anhydride, and esters of polyols, such as glucose pentaacetate. Other known bleach activators are the acetylated mixtures of sorbitol and mannitol described, for example, in European patent application EP-A-0 525 239 and acetylated pentaerythritol. The content of bleach activators in the bleach-containing detergent is in the usual range, preferably between 1 and 10% by weight and more preferably between 3 and 8% by weight. Particularly preferred bleach activators are N,N,N',N'-tetraacetyl ethylenediamine (TAED), 1,5-diacetyl-2,4-dioxohexahydro-1,3,5-triazine (DADHT) and acetylated sorbitol-mannitol mixtures (SORMAN).

Suitable enzymes are, in particular, enzymes from the class of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discoloration in the washing process. Cellulases and other glycosyl hydrolases can contribute towards color retention and towards increasing fabric softness by removing pilling and microfibrils. Oxidoreductases may also be used for bleaching and for inhibiting dye transfer. Enzymes obtained from bacterial strains or fungi, such as Bacillus subtilis, Bacillus licheniformis, Streptomyces griseus and Humicola insolens are particularly suitable. Proteases of the subtilisin type are preferably used, proteases obtained from Bacillus lentus being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios.

The enzymes may be adsorbed to supports and/or encapsulated in membrane materials to protect them against premature decomposition. The percentage content of enzymes, enzyme mixtures or enzyme granules may be, for example, about 0.1 to 5% by weight and is preferably from 0.1 to about 2% by weight.

Besides the nonionic surfactants normally present as a liquid component, the liquid detergents may also contain organic solvents, for example mono- or polyhydric alcohols containing 1 to 4 carbon atoms, as solvents. Preferred alcohols are ethanol, propane-1,2-diol, glycerol and mixtures thereof. The compositions preferably contain 2 to 12% by weight and more preferably 3 to 10% by weight of ethanol or a mixture of ethanol and glycerol.

Besides the monohydric and/or polyhydric short-chain alcohols, such as ethanol, propylene glycol and/or glycerol, liquid organic ethers, for example diisopropyl monomethyl ether, are also preferred, particularly in nonaqueous liquid detergents.

A powder-form or granular detergent according to the present invention preferably contains 2 to 20% by weight of $C_{12-18}$ alkyl sulfates, the percentage of carbon chains with fewer than 14 carbon atoms being less than 10%, based on the $C_{12-18}$ alkyl sulfate content, 2 to 20% by weight of $C_{9-13}$ alkyl benzenesulfonates, the $C_{12-18}$ alkyl sulfates and the $Cr_{13}$ alkyl benzenesulfonates being present in a ratio of 1:10 to 10:1, 15% by weight to 55% by weight of inorganic and/or organic builders, up to 10% by weight of other anionic surfactants, 1% by weight to 20% by weight of nonionic surfactants, up to 25% by weight and more particularly from 1% by weight to 15% by weight of bleaching agents, up to 8% by weight and more particularly from 0.5% by weight to 6% by weight of bleach activator and up to 20% by weight and more particularly from 0.1% by weight to 15% by weight of inorganic salts, more particularly alkali metal carbonate, sulfate and/or silicate, and up to 2% by weight and more particularly from 0.4% by weight to 1.2% by weight of enzymes and other typical detergent ingredients, such as structure breakers, foam inhibitors, optical brighteners, enzymes, stabilizers, especially for peroxygen compounds and enzymes, fabric softeners, redeposition inhibitors, foam inhibitors and dyes and perfumes.

A liquid detergent according to the present invention preferably contains 2 to 20% by weight of $C_{12-18}$ alkyl sulfates, the percentage of carbon chains with fewer than 14 carbon atoms being less than 10%, based on the $C_{12-18}$ alkyl sulfate content, 2 to 20% by weight of $C_{9-13}$ alkyl benzenesulfonates, the $C_{12-18}$ alkyl sulfates and the $C_{9-13}$ alkyl benzenesulfonates being present in a ratio of 1:10 to 10:1, 4 to 25% by weight of liquid nonionic surfactants, up to 10% by weight of solvent, up to 10% by weight of builders, up to 3% by weight of enzymes and up to 2% by weight of other typical detergent ingredients.

Perfumes may be also be incorporated in the detergents, particularly powder-form or granular detergents, in the form of solid compounds. These concentrated perfume compounds may be separately produced, for example by granulation, compacting, extrusion, pelleting or other agglomeration processes. Suitable carrier materials are, for example, cyclodextrins; the cyclodextrin/perfume complexes may additionally be coated with other auxiliaries. The separate production of perfume beads is described, for example, in earlier German patent application DE-A-197 46 780.6 which discloses a process in which a solid substantially water-free premix of carrier materials, optionally auxiliaries and 5 to 25% by weight of perfume is subjected to granulation or press agglomeration.

EXAMPLES

Washing performance was tested under simulated practical conditions in Miele W 918 Novotronic washing machines. The machines were loaded with 3.5 kg of domestic laundry (bed linen, table linen, underwear) and 0.5 kg of test fabrics. Commercially obtainable artificially soiled cotton cloth and polyester/cotton blend and cotton cloth and polyester/cotton blend naturally soiled by a machine-based process were used as the test fabrics.

Washing Conditions

Tap water with a hardness of 16° d (equivalent to 160 mg CaO/l) was used for the main wash cycle at 40° C. and 60° C. (4.3 g/l detergent, washing time 60 mins.). The laundry was rinsed three times with tap water, spun and dried. The liquor ratio—kg laundry:liter(l) wash liquor—was 1:4.5.

TABLE 1

| | Example (powder) | |
|---|---|---|
| Component | 1 | 2 |
| $C_{11-13}$ alkyl benzenesulfonate | 14.8 | 12.0 |
| $C_{14-16}$ alkyl sulfate[1] | | 3.6 |
| $C_{12-18}$ alcohol × 7 EO | 3.8 | |
| $C_{12-14}$ alcohol × 5.5 EO | | 3.0 |
| Tallow alcohol × 5 EO | 0.53 | 0.53 |
| $C_{12-18}$ soap (Na salt) | 0.9 | 0.9 |
| Soda | 11.8 | 11.8 |
| Soil repellent polymer[2] | 0.75 | 0.75 |
| Waterglass | 1.6 | 1.6 |
| Na perborate monohydrate | 12.05 | 12.05 |
| Hydroxyethyl diphosphonate | 0.5 | 0.5 |
| Silicone oil | 0.6 | 0.6 |
| Zeolite | 20.61 | 20.61 |
| Polymeric polycarboxylate[3] | 5.15 | 5.15 |
| TAED | 8.0 | 8.0 |
| Enzyme | 3.99 | 3.99 |
| Water and salts | to 100 | to 100 |

[1]70% by weight $C_{14}$ alcohol, 30% by weight $C_{16}$ alcohol
[2]Repel-O-Tex ® (product of Rhone-Poulenc S.A.)
[3]Sokalan ® CP5 (product of BASF AG, Ludwigshafen)

The test fabrics were soiled with the various soils mentioned below. Cleaning performance was determined by reflectance measurement. (Measurement of whiteness: Zeiss reflectometer, 465 nm, effect of brightener faded out). The tests were repeated five times. The reflectance values shown are the average values of all the measurements. The results are set out in Tables 2 and 3.

The abbreviations used in the Tables have the following meanings:

fabrics: C=cotton, P=polyester, CRPC=crease-resistant polyester/cotton soils: DW=dust/wool fat, DS=dusvsebum, RF4 carbon black/wool fat, MU=makeup, LS=lipstick, T=tea

TABLE 2

| | Soil | | | | |
|---|---|---|---|---|---|
| | Fat/pigment stains | | | | Fat/carbon black stains |
| Example | DW-C | DS-C | DS-CRC | DS-CRPC | RF4-CRPC |
| 1 (Comparison) | 60.3 | 77.3 | 78.7 | 74.2 | 72.4 |
| 2 (Invention) | 61.3 | 78.0 | 80.1 | 74.3 | 74.4 |

| | Soil | | |
|---|---|---|---|
| | Cosmetic stains | | Bleachable |
| | LS1-CRPC | MU-CRPC | stains T-C |
| 1 Comparison) | 74.3 | 58.6 | 63.0 |
| 2 (Invention) | 76.4 | 56.1 | 62.6 |

In Table 3, the average reflectance values over the individual soil types are shown in column 2 and the total reflectance values over all soil types in column 3.

TABLE 3

| Example | Average reflectance | Total reflectance values |
|---|---|---|
| 1 (Comparison) | 69.6 | 556.8 |
| 2 (Invention) | 70.4 | 563.2 |

It is clear from Table 3 that the formulations containing the special alkyl sulfates according to the invention show improved cleaning performance over the range of most commonly encountered soils.

What is claimed is:

1. A surfactant combination for use in detergents, the combination comprising:

a) $C_{12-18}$ alkyl sulfates wherein less than 10% by weight of the $C_{12-18}$ alkyl sulfates, based on the $C_{12-18}$ alkyl sulfates, have carbon chains with fewer than 14 carbon atoms; and b) $C_{9-13}$ alkyl benzenesulfonates in a weight ratio a:b of 1:10 to 10:1.

2. The surfactant combination of claim 1, wherein less than 10% by weight of the $C_{12-18}$ alkyl sulfates have carbon chains with more than 16 carbon atoms.

3. The surfactant combination of claim 1, wherein 10% to 20% by weight of the $C_{12-18}$ alkyl sulfates have carbon chains with more than 16 carbon atoms.

4. The surfactant combination of claim 1, wherein 40% to 80% by weight of the $C_{12-18}$ alkyl sulfates have carbon chains with 14 carbon atoms.

5. The surfactant combination of claim 1, wherein the $C_{12-18}$ alkyl sulfates and the alkyl benzenesulfonates are present in a ratio of 1:1 to 4:1.

6. The surfactant combination of claim 1, comprising one or more nonionic surfactants selected from the group consisting of alkoxylated $C_{8-18}$ alcohols, alkoxylated fatty acid alkyl esters, amine oxides, and polyhydroxyfatty acid amines.

7. The surfactant combination of claim 6, wherein the alkoxylated $C_{8-18}$ alcohols comprise $C_{12-16}$ fatty alcohol alkoxylates with an average degree of alkoxylation of 5.2 to 5.8.

8. A powder-form or granular detergent, comprising:

a) 2% to 20% by weight of $C_{12-18}$ alkyl sulfates, wherein less than 10% by weight of the $C_{12-18}$ alkyl sulfates, based on the $C_{12-18}$ alkyl sulfate content, have carbon chains with fewer than 14 carbon atoms;

b) 2% to 20% by weight of $C_{9-13}$ alkyl benzenesulfonates;

c) 15% by weight to 55% by weight of one or more inorganic or organic builders;

d) up to 10% by weight of other anionic surfactants;

e) 1% by weight to 20% by weight of nonionic surfactants;

f) up to 25% by weight of bleaching agents;

g) up to 8% by weight of bleach activator;

h) up to 20% by weight of inorganic salts; and i) up to 2% by weight of enzymes, wherein the $C_{12-18}$ alkyl sulfates and the $C_{9-13}$ alkyl benzenesulfonates are in a weight ratio of 1:10 to 10:1.

9. The detergent of claim 8, comprising 1% to 15% by weight of bleaching agents, 0.5% to 6% by weight of bleach activator, 0.1% to 15% by weight of inorganic salts, and 0.4% to 1.2% by weight of enzymes ingredients.

10. The detergent of claim 9, wherein the inorganic salts comprises one or more selected from the group consisting of alkali metal carbonates, sulfates, and silicates.

11. The detergent of claim 8, wherein the builders are selected from the group consisting of phosphates, zeolites, water-soluble alkali metal silicates, and organic builders.

12. The detergent of claim 11, wherein the builders comprise polycarboxylates, (co)polymeric polycarboxylates, biodegradable terpolymers, or quaternary polymers.

13. A liquid detergent, comprising:

a) 2% to 20% by weight of $C_{12-18}$ alkyl sulfates, wherein less than 10% by weight of the $C_{12-18}$ alkyl sulfates, based on the $C_{12-18}$ alkyl sulfate content, have carbon chains with fewer than 14 carbon atoms;

b) 2% to 20% by weight of $C_{9-13}$ alkyl benzenesulfonates;

c) 4% to 25% by weight of liquid nonionic surfactants;

d) up to 10% by weight of solvent;

e) up to 10% by weight of builders; and f) up to 3% by weight of enzymes;

wherein the $C_{12-18}$ alkyl sulfates and the $C_{8-18}$ alkyl benzenesulfonates are in a ratio of 1:10 to 10:1.

* * * * *